US005938133A

United States Patent [19]

Bayliss et al.

[11] Patent Number: 5,938,133

[45] Date of Patent: Aug. 17, 1999

[54] SUPPORT ASSEMBLY FOR A GYRATORY CRUSHER

[75] Inventors: John Andrew Bayliss, Crawley; Terry Richard Fielding, Lathlain; James Willian Shannon, City Beach, all of Australia

[73] Assignee: Wescone Crushers Pty Ltd, Australia

[21] Appl. No.: 08/776,890

[22] PCT Filed: Aug. 11, 1995

[86] PCT No.: PCT/AU95/00490

§ 371 Date: Feb. 11, 1997

§ 102(e) Date: Feb. 11, 1997

[87] PCT Pub. No.: WO96/04994

PCT Pub. Date: Feb. 22, 1996

[30] Foreign Application Priority Data

Aug. 12, 1994 [AU] Australia ..... PM7390

[51] Int. Cl.[6] ..... B02C 2/04

[52] U.S. Cl. ..... 241/214

[58] Field of Search ..... 241/207–216

[56] References Cited

U.S. PATENT DOCUMENTS

| | | | |
|---|---|---|---|
| 28,031 | 4/1860 | Wood . | |
| 180,620 | 8/1876 | Motte . | |
| 997,918 | 7/1911 | Jones . | |
| 1,549,555 | 8/1925 | Jorgensen . | |
| 2,326,750 | 8/1943 | Browning . | |
| 2,327,384 | 8/1943 | Annesley | 241/216 |
| 2,579,239 | 12/1951 | Lippmann . | |
| 2,679,985 | 6/1954 | Gruender . | |
| 2,787,424 | 4/1957 | Lippmann . | |
| 2,787,425 | 4/1957 | Gruender . | |
| 2,901,189 | 8/1959 | Conway . | |
| 2,972,448 | 2/1961 | Dorsey . | |
| 3,080,126 | 3/1963 | Kueneman et al. | 241/216 |
| 3,312,404 | 4/1967 | Allen . | |
| 3,565,353 | 2/1971 | Adam . | |
| 3,743,193 | 7/1973 | DeDiemar et al. . | |
| 3,744,728 | 7/1973 | Treppish . | |
| 3,750,967 | 8/1973 | DeDiemar et al. . | |
| 3,771,735 | 11/1973 | Decker et al. | 241/216 |
| 3,813,047 | 5/1974 | Torrence et al. . | |
| 3,837,585 | 9/1974 | Decker et al. . | |
| 3,873,037 | 3/1975 | Decker et al. . | |
| 3,957,213 | 5/1976 | Stockman et al. . | |
| 4,027,825 | 6/1977 | Coxhill . | |

(List continued on next page.)

FOREIGN PATENT DOCUMENTS

| | | |
|---|---|---|
| 618545 | 2/1989 | Australia . |
| 1061837 | 12/1983 | U.S.S.R. . |
| 898460 | 1/1987 | U.S.S.R. . |
| WO 89/00455 | 1/1989 | WIPO . |

*Primary Examiner*—Mark Rosenbaum
*Attorney, Agent, or Firm*—Wolf, Greenfield & Sacks, P.C.

[57] ABSTRACT

The gyratory crushing apparatus includes a bowl having an inner wall which defines a chamber for receiving frangible or friable material to be crushed, the chamber having a central axis and terminating in a throat defining a central discharge opening, a crushing head disposed in the bowl and having upper and lower ends which are interconnected by a peripheral wall which is concentric with respect to a gyratory axis of the head, a support assembly by which the head is supported in the chamber and which includes a shaft, and a drive arrangement coupled to the shaft. The shaft is of integral construction having upper and lower portions, and the head is mounted on the upper portion, with the upper portion having an axis substantially co-incident with the gyratory axis of the head. The lower portion of the shaft has an axis which is substantially co-incident with the central axis of the bowl, with the axes of the upper and lower portions of the shaft intersecting at a fixed point located proximate to, or co-incident with, the lower end of the head. With rotation of the shaft about the axis of its lower portion under the action of the drive arrangement, gyratory motion is imparted to the head to provide a crushing action between the bowl and peripheral wall of the head, on material received in the chamber.

25 Claims, 2 Drawing Sheets

U.S. PATENT DOCUMENTS 4,034,922 7/1977 Coxhill .
4,037,800 7/1977 Coxhill .
4,084,756 4/1978 Coxhill .
4,168,036 9/1979 Werginz .
4,192,472 3/1980 Johnson .
4,198,003 4/1980 Polzin et al. .
4,206,881 6/1980 Werginz .
4,272,030 6/1981 Afanasiev et al. .
4,316,585 2/1982 Guzik .
4,339,087 7/1982 Pollak .
4,351,490 9/1982 Johnson .
4,391,414 7/1983 Reiter .
4,410,143 10/1983 Polinski .
4,478,373 10/1984 Gieschen .
4,512,525 4/1985 Cameron .
4,585,179 4/1986 Tsuji et al. .
4,592,517 6/1986 Zarogatsky et al. .
4,602,746 7/1986 Stockmann et al. ..... 241/215
4,615,491 10/1986 Batch et al. .
4,679,741 7/1987 Hansen .
4,681,269 7/1987 Arawaka .
4,787,563 11/1988 Tanaka et al. .
4,844,362 7/1989 Revnivtsev et al. .
4,892,257 1/1990 Stoeckmann et al. .
4,895,311 1/1990 Arawaka .
4,976,470 12/1990 Arawaka .
5,035,368 7/1991 Finley et al. .
5,115,991 5/1992 Saari et al. .
5,152,468 10/1992 Virtamo et al. .
5,190,229 3/1993 Kaiser .
5,312,053 5/1994 Ganser, IV .
5,350,125 9/1994 Clark .

SUPPORT ASSEMBLY FOR A GYRATORY CRUSHER

FIELD OF THE INVENTION

The present invention relates to a gyratory crusher for crushing frangible and friable material having a gyrating crushing head and, in particular, to a support assembly for use in the crusher to support the crushing head.

BACKGROUND OF THE INVENTION

Australian Patent Specification 618545 (AU-B-19935/88) discloses a gyratory crushing apparatus including a bowl and a crushing head. A support assembly is arranged to support the head at opposite axial ends thereof to dispose the head at an angle to the central axis of the bowl. The crushing head has a gyratory axis which intersects with the central axis of the bowl at a pivot point located at the bottom of the crushing head. The crushing apparatus further includes a drive assembly for driving the crushing head about the pivot point causing the top of the crushing head to oscillate in a direction substantially transverse to the central axis of the bowl and to cause the bottom of the crushing head to oscillate predominantly in a direction parallel to the central axis. In the illustrated embodiments of specification 618545, the support assembly includes a rotatable shaft connected at one axial end to the drive assembly and journalled or pin mounted at its other axial end to an upper end of the crushing head, and a universally pivotable joint including a knuckle on which a lower end of the head is seated. The connection between the rotatable shaft and the crushing head is arranged to permit relative rotational movement between the shaft and the head.

A problem with the support assembly disclosed in specification 618545 is that precise adjustment is required to establish and maintain the proper geometric relationship between the vertical axis of the bowl, the rotatable shaft and the lower crushing head knuckle. As it has been found difficult to achieve the required precision with reliability or repeatability, the apparatus has not always performed satisfactorily and can suffer premature mechanical damage.

An aim of the present invention is to provide an improved support assembly for a gyratory crushing apparatus which at least ameliorates the above problem.

SUMMARY OF THE INVENTION

The invention provides a gyratory crushing apparatus, for crushing frangible or friable material, the apparatus including a bowl having an inner wall which defines a chamber for receiving the material, the chamber having a central axis and terminating in a throat defining a central discharge opening, a crushing head disposed in the bowl, the head having upper and lower ends which are interconnected by a peripheral wall which is concentric with respect to a gyratory axis of the head, a support assembly by which the head is supported in the chamber and which includes a shaft, and a drive arrangement coupled to the shaft, wherein the shaft is of integral construction having upper and lower portions, the head being mounted on the upper portion, with the upper portion having an axis substantially co-incident with the gyratory axis of the head, and the lower portion having an axis which is substantially co-incident with the central axis of the bowl, the axes of the upper and lower portions of the shaft intersecting at a fixed point located proximate to, or co-incident with, the lower end of the head such that, with rotation of the shaft about the axis of its lower portion under the action of the drive arrangement, gyratory motion is imparted to the head to provide a crushing action between the bowl and the peripheral wall of the head, on material received in the chamber.

The configuration of the shaft of the support assembly and the location of the crushing head on the shaft enables the crushing head to gyrate in a similar manner to that disclosed in specification 618545, but without requiring the use of a universally pivotable joint at the lower end of the crushing head. However, to fully achieve the movement of the crushing head disclosed in specification 618545, it is necessary for the crushing head to be mounted on the upper portion of the shaft in a manner enabling relative rotational movement between the shaft and the head about the axis of the upper portion of the shaft.

Consequently, in a particularly preferred arrangement, the support assembly includes bearing surfaces to enable the crushing head to rotate on the shaft and to enable the shaft to rotate relative to the bowl. However, as large loads are induced on the crushing head in operation of the apparatus, and as this loading is variable, problems exist in designing a suitable bearing arrangement for the support assembly.

The problems of providing a suitable bearing arrangement are complicated by the need to ensure that the apparatus is reliable, easily serviceable, and that the cost of manufacture is kept to a minimum. To provide reliability, it is desirable to allow some tolerance within the bearings without causing the bearings to be prone to fretting or other damage by inadvertent movement of the various components.

In a particularly preferred arrangement, the crushing head is supported in position on the upper portion of the shaft by a plurality of bearings permitting relative rotational movement between the head and the upper portion of the shaft about the axis of the upper portion. The bearings are arranged to transfer, relative to the axis of the upper portion of the shaft, both axially and radially induced forces between the crushing head and the shaft. Most preferably only one of the bearings influences the axial position of the crushing head on the upper portion of the shaft.

Preferably, the bearings are arranged such that a plurality of the bearings are arranged to transfer radial forces between the head and the shaft, and wherein only one of the bearings is arranged to transfer the axial forces between the head and the shaft. Preferably the bearing arranged to transfer the axial forces influences the axial location of the head on the shaft, whereas the bearings arranged to transfer the radial forces retain the crushing head substantially co-axial with the axis of the upper portion of the shaft. This arrangement has the advantage of being able to accommodate the loading on the head while maintaining required positioning of the head on the shaft, yet reduces the need for extreme precision in the manufacture of the relevant parts.

In a further preferred arrangement, the shaft is also mounted relative to the bowl through a plurality of bearings permitting rotation of the shaft relative to the bowl on the central axis of the chamber. Typically the shaft is mounted to a support frame of the apparatus and the bearings are arranged to transfer, relative to the central axis of the chamber, both axially and radially induced forces between the shaft and the frame. Most preferably only one of the bearings influences the axial position of the shaft relative to the bowl.

Preferably a plurality of bearings provided to transfer radial forces between the shaft and the frame and most preferably only one of these bearings is able to transfer the axial forces. Preferably the bearing arranged to transfer the axial forces influences the axial location of the shaft relative to the bowl whereas the bearings arranged to transfer the radial forces align the shaft to retain the axis of the lower portion of the shaft substantially co-incident with the central axis of the chamber. Typically, the frame of the apparatus is also arranged to support the bowl. In a particularly preferred arrangement the bearing which transfers the axial forces engages the lower portion of the shaft remote from the fixed point.

Individual bearings may be arranged to transfer only radial forces or axial forces between the shaft and crushing head or bowl, or may be arranged to transfer both radial and axial forces. Furthermore, the bearings may be of simple or composite form.

The crushing apparatus incorporates a drive arrangement to drive the crushing head in the required gyratory motion about the fixed point. Preferably this drive arrangement is coupled to the shaft of the support assembly to drive the shaft about the central axis of the chamber to cause the required motion of the crushing head. In this way, the support assembly may form part of the drive arrangement.

In one form of drive arrangement, the shaft of the support assembly includes a further drive portion extending from the upper portion of the shaft. The drive portion is connected to or integrally formed with the upper portion of the shaft to maintain the integral construction of the shaft and is arranged with its axis substantially co-incident with the central axis of the chamber. Preferably a drive assembly is connected to the drive portion of the shaft and operable to rotate the shaft about the central axis of the chamber.

To establish the required gyratory movement of the crushing head, it is necessary that the drive portion and upper portion of the shaft move in synchronisation. Preferably the drive portion is integral with the upper portion of the shaft such that the shaft can be formed as a single piece. However, the drive portion may be connected to the upper portion of the shaft, and preferably is separable from the upper portion. This latter arrangement may be preferable in certain circumstances to facilitate assembly and disassembly of the parts. If the drive portion is separable from the upper portion of the shaft it is necessary that they are connected together such that, as with an integral drive portion, there is synchronised movement of the drive and upper portions. This may be achieved by the use of a plurality of dowl pins or the like which extend between the upper portion and the drive portion of the shaft.

The drive assembly may be of any suitable form such as a hydraulic drive, gear drive or a direct belt and pulley drive. In one form, a variable speed hydraulic drive is directly coupled to the drive portion and provides a simple and instantaneous means of adjusting the speed to optimise the crushing performance. However, to reduce the manufacturing costs, a bevelled gear drive may be provided, with this having a bevelled gear pinion fixed to an input shaft and arranged to engage a bevelled gear located on the drive portion. A belt and pulley system may transfer power from a conventional drive motor or engine to the input. Typically speed changes are accommodated by changing the pulley sizes.

In an alternative and particularly preferred form, the drive assembly is connected to the lower portion of the shaft. Again the drive assembly may be of any suitable form. However, in a preferred arrangement, an input shaft of the drive assembly is coupled to the lower portion of the shaft through a bevelled gear arrangement similar to that described in relation to the top drive arrangement.

An advantage of using a lower drive is that it simplifies the construction of the apparatus and ensures that there is no obstruction to feeding material into the chamber. Furthermore, sealing of the drive arrangement from the ingress of material can be simplified and improved.

It will be convenient to hereinafter describe the crushing apparatus of the invention in greater detail by reference to embodiments of the invention illustrated in the accompanying drawings. The particularity of those drawings in the related description is not to be understood as superseding the generality of the preceding broad description of the invention.

DETAILED DESCRIPTION

Figure 1:
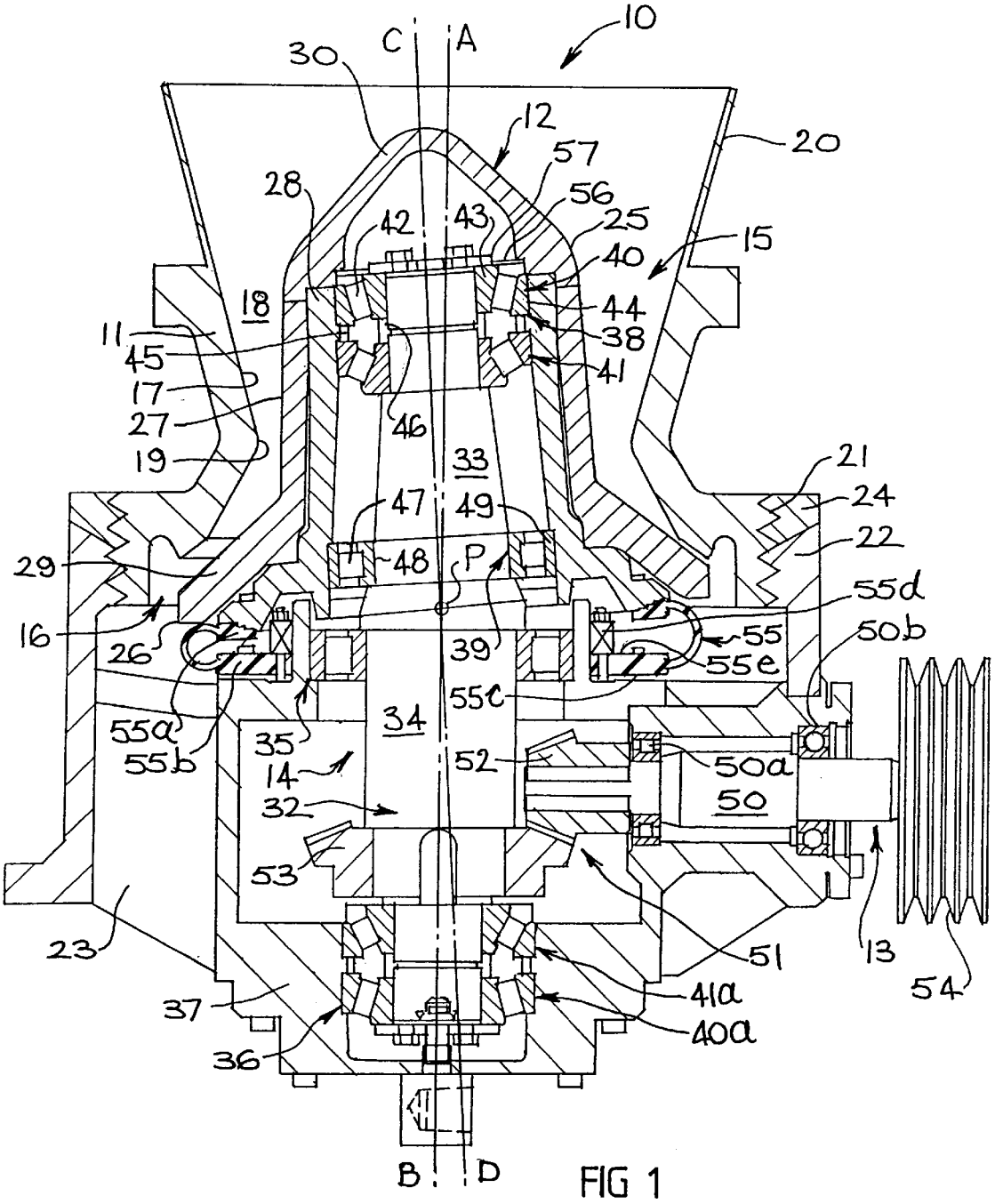
FIG. 1 is a schematic illustration of a crushing apparatus according to a first embodiment of the present invention.

FIG. 1 illustrates a crushing apparatus 10 including a bowl 11, crushing head 12, drive assembly 13 and support assembly 14.

The bowl 11 includes open ends (15,16) which are interconnected by a wall surface 17 incorporating a wear resistant liner (not shown). The wall surface 17 defines a chamber 18, with the upper end 15 forming a feed opening for the chamber 18 and the lower end 16 forming a discharge opening. Downwardly from the feed opening 15, the wall surface 17 converges inwardly to a narrow constriction 19, and then diverges outwardly to the discharge opening 16. The chamber is generally symmetrical about a central axis A-B. A feed cone 20 is mounted to the top of the bowl 11 to facilitate feeding of material into the chamber 18.

Around its lower periphery, bowl 11 defines a thread formation 21 by which it is mounted on a spider 22 forming part of a support frame 23 of the apparatus.

With bowl 11 rotated in spider 22 so as to attain a required vertical position, bowl 11 is locked in that position. For such locking, an annular locking ring 24 is screwed onto thread formation 21, and tightened into strong clamping engagement with the spider 22.

The crushing head 12 has an upper end 25 and a lower end 26. Between the ends 25 and 26, the head 12 has an inner bearing housing 28 and seated co-axially on and around housing 28, a head liner 29 which defines an outer, crushing surface 27 of the head 12. A cap 30 is mounted on the upper end 25 of the head 12, and is secured to housing 28 by bolts (not shown) which engage in the top end face of housing 28 to retain liner 29 seated on the housing 28. The housing 28 and liner 29 have a common axis C-D which defines a gyratory axis for the head 12.

The crushing head 12 is supported in position within the chamber 18 by the support assembly 14. The support assembly 14 includes an eccentric shaft 32 having mutually inclined upper portion 33 and lower portion 34. The respective central axis of the portions 33 and 34 intersect at a fixed point P. The shaft 32 is rotatably mounted through bearings 35 and 36 to a lower frame 37 of the apparatus 10 with the axis of the lower portion 34 of the shaft co-incident with the central axis A-B of the chamber 18. As the shaft 32 is eccentric, locating the lower portion 34 in this position causes the upper portion 33 to extend at an angle from the central axis A-B of the chamber 18.

The crushing head 12 is rotatably mounted on the upper portion 33 of the shaft 32 through bearings 38 and 39 and is aligned on the upper portion 33 such that the central axis C-D of the head 12 is co-incident with the axis of the upper portion 33 of the shaft 32. Furthermore, the lower end 26 of the head 12 is substantially coincident with the fixed point P. In this way the crushing head 12 is disposed at an angle to the central axis A-B of the chamber 18.

Bearing 38 is a composite bearing which effectively transfers both axial and radial forces from the crushing head 12 to the eccentric shaft 32. The bearing 38 does not require field adjustment or especially skilled installation, and can simply be installed and bolted tight. The bearing 38 is arranged to transfer, relative to the central axis of the upper portion 33 of the shaft, axial forces induced on the crushing head 12 during operation of the crushing apparatus 10, together with a portion of radial forces.

The composite bearing 38 is made up of two bearings 40 and 41, each with tapered conical rollers 42 and matching inner raceway 43 and outer raceway 44. These are supplied with matching spacers 45 and 46 between the outer and inner raceways. These spacers permit the bearing components to be correctly placed after assembly with simple "bolt up" procedures. The top bearing 40 has a roller cone angle which transfers radial and axial forces, with the radial forces predominant. The axial force transfer is adequate to offset vertically upward forces induced on the crushing head from the lower bearing 41, and random upward forces on the crushing head. The lower bearing 41 has a steeper, opposite roller cone angle, enabling it to transfer both radial crushing forces and vertically downwards crushing forces.

Bearing 39 is a plain cylindrical roller bearing. The rolling elements 47 are retained by the inner raceway 48. The outer raceway 49 is free to move axially relative to the rolling elements and the inner raceway 48. The raceways can be interference fitted to the shaft 32 and bearing housing 28, and then bought together by simple axial movement of the inner part into the outer part. The bearing 39 is arranged to transfer radial forces only.

Bearing 35 is similar to bearing 39 and again is arranged to transfer only radial forces. Bearing 35 is a larger plain cylindrical roller bearing than bearing 39, and therefore is able to transfer larger radial forces then bearing 35.

Bearing 36 is identical in size, arrangement and purpose to bearing 38, having two bearings 40*a* and 41*a*. The only difference is that the bearing 36 is inverted as compared to bearing 38 such that the bearing 41*a* with the steeper roller angle is located on the upper side where it is best placed to transfer the vertically downward crushing forces from the eccentric shaft 32 to the bottom section of the crusher frame 37.

Both bearing 35 and 36 assist in aligning and supporting the shaft 32 such that the axis of lower portion 34 is co-incident with the central axis A-B of the chamber 18. However only bearing 36 has any influence on the axial position of the shaft. Similarly both bearings 38 and 39 assist in aligning and supporting the head 12 such that it extends co-axially with the upper portion 33 of the shaft 32, while only bearing 38 determines the axial position of the head 12 on the shaft 32.

The eccentric shaft 32 is driven about the central axis A-B of the chamber 18 by the drive assembly 13. The drive assembly 13 comprises a drive shaft 50 which is rotatable in bearings 50*a* and 50*b* and is coupled to the lower portion 34 of the eccentric shaft through a bevelled gear drive 51. In drive 51, a pinion 52 is located on a first end of the drive shaft 50 and engages a crown wheel 53 secured around the lower portion of the shaft 32. A pulley 54 is secured to the other end of the drive shaft 50 enabling the shaft 50 to be driven, via belts and a drive motor (not shown).

A seal 55 is located between the crushing head 12 and the lower frame 37. In the illustrated arrangement, the seal 55 comprises a flexible bell seal which is clamped to the inner bearing housing 28 and the crusher frame 37. The top peripheral edge of the seal 55 is secured to the head 12 by a clamp plate 55*a*. The bottom peripheral edge of seal 55 is held in clamp assembly 55*b* which has a friction liner 55*c* on its lower surface. Springs 55*d*, mounted on housing 37, urge a pressure plate 55*e* down on to assembly 55*b*, to force liner 55*c* into frictional engagement with housing 37. Thus, in addition to seal 55 providing a seal around the lower periphery of head 12, between the latter and housing 37, the arrangement allows rotation of head 12 on upper portion 33 of shaft 32 but tends to retard or prevent such rotation.

A further seal 56 is provided within the head cap 30. A bearing retaining plate 57 is secured to the top of the shaft 32 which clamps the sealing ring 56 onto the top of the shaft 32 and in position over the top of the inner bearing housing 28.

In operation of the apparatus 10, the drive assembly 13 drives the eccentric shaft 32 around the central axis A-B of the chamber 18. As the upper portion 33 of the shaft 32 is inclined to the central axis A-B and the crushing head 12 is disposed co-axially with the axis of the upper portion 33, rotation of the shaft 32 causes the crushing head 12 to gyrate about the fixed point P. Furthermore, as the lower end 26 of the crushing head 12 is located proximate to, or coincident with, the fixed point P, the motion of the upper end 25 of the crushing head is predominantly transverse to the central axis A-B of the chamber, while the motion at the lower end of the head is substantially parallel to the axis A-B.

Material is fed into the chamber 18 through the feed chute 20 and undergoes crushing in chamber 18, between the liner of bowl 17 and the crushing head liner 29. The movement of the crushing head 12 causes the crushing action to be such that when the gap between the bowl liner 17 and the crushing head 12 is at a minimum at the upper end of the crushing head, it is at a maximum at the bottom of the crushing head on the same side (this configuration is shown on the left hand side of the crushing head in FIG. 1); with the converse applying on the right hand side of head 12. Further, as the shaft 32 continues to rotate, the configuration at that location changes such that the gap between the bowl and the upper end of the crushing head on the left hand side increases while the gap at the lower end of the bowl at the left hand side decreases. Thus, when the shaft has rotated through 180° from the position shown in FIG. 1, the gap at the upper end is at a maximum at the left hand side and the gap at the lower end is at a minimum at the left hand side (as shown in FIG. 1 for the right side of the crushing head).

This crushing action is advantageous as it is able to reduce the amount of oversized material to less than 10% of output. Also crushing using very high reduction ratios of up to 30:1 is able to be achieved satisfactorily.

A further advantage of the apparatus is that the components are simple to manufacture and assemble. In particular, with the bearing arrangement of the support assembly, conventional bearings can be used without necessitating precise adjustment of the bearings or other components during assembly or during reassembly after service. This advantage has been achieved to a large extent because only one of the bearings influences the axial position of the shaft relative to the lower frame of the apparatus and similarly only a single bearing influences the axial location of the crushing head on the upper portion of the shaft. In this way the bearings are able to tolerate random minor inaccuracies in the components and differential thermal expansion of the parts. Furthermore, all bearing and crushing head wear parts are tightly fitted so that fretting is eliminated.

A further advantage is that obstructions to feed material entering the crushing chamber can be avoided, enabling preferential wear to be minimised, regardless to whether the feed is flooded or in the form of discrete samples. Furthermore, if cleaning of the crushing chamber is required between crushing of successive samples, there is no obstruction to access to the chamber.

Yet a further advantage is that the top of the crushing head is sealed and abrasive particles are completely excluded. Furthermore with the incorporation of the bell seal, foreign matter is fully excluded from the drive components.

A further advantage is that the head liner which is formed from a wear resistant material can be easily and quickly changed without requiring special tools. Furthermore during replacement of wear parts, the crushers internal drive components are not exposed to contamination by harmful or abrasive dirt.

Yet a further advantage is that a drive speed can be altered by belt and pulley change or by fitting a variable speed, electric or hydraulic drive motor. Alternatively, a combustion engine can be conveniently used to power the crusher. In this way the apparatus allows flexibility in the source of drive power and in the speed of the drive.

Figure 2:
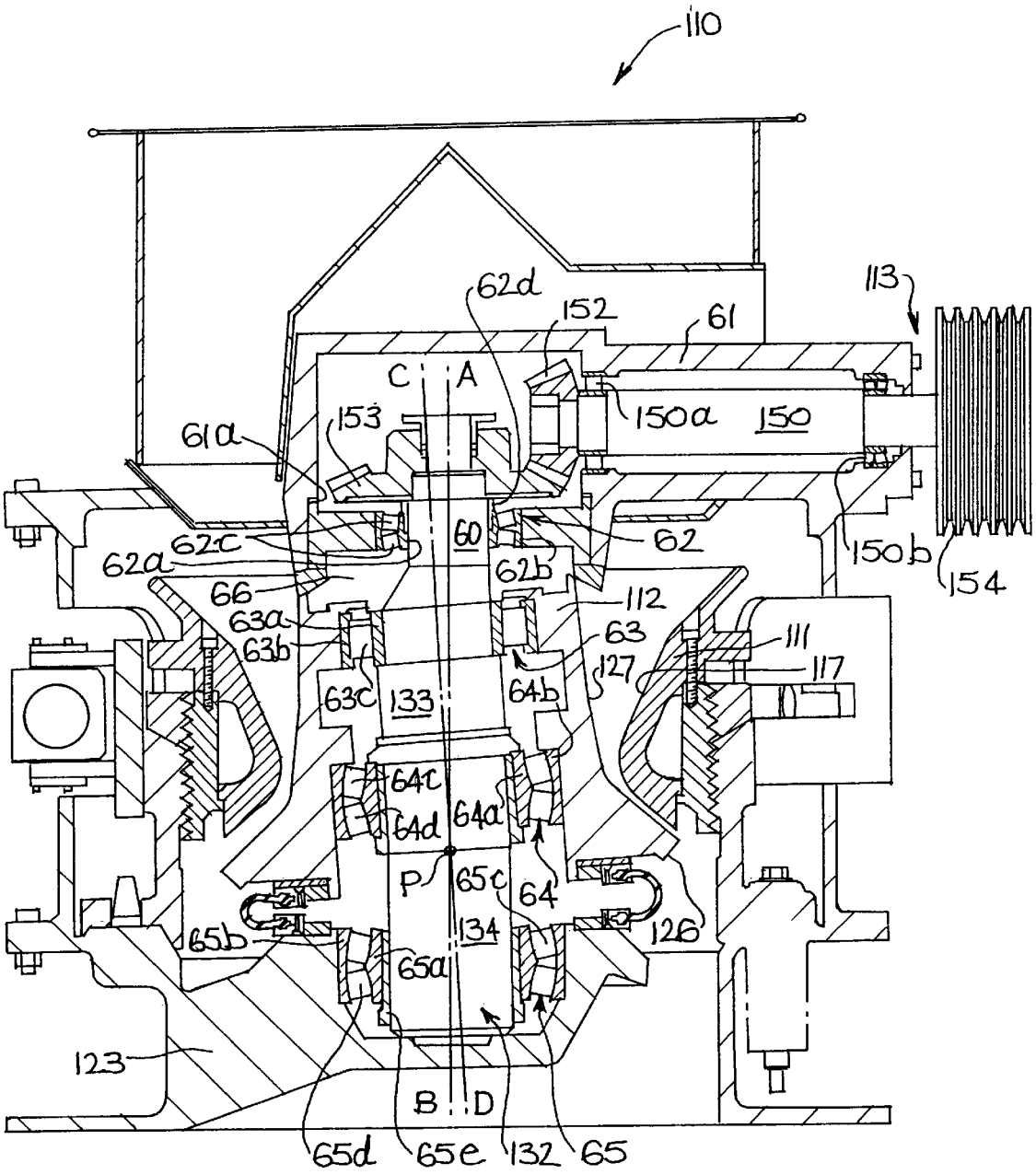
FIG. 2 is a schematic illustration of a crushing apparatus according to a second embodiment of the present invention.

FIG. 2 illustrates a crushing apparatus 110, of which features corresponding to those of apparatus 10 of FIG. 1 have the same reference numeral, plus 100. The general arrangement and functioning of crusher 110 will be understood from the description directed to FIG. 1, and further description therefore is limited to principal matters of difference.

In crusher 110, the bowl 111 is shown again in general form not showing the wear liner incorporated in its peripheral wall to define inner face 117. Also, head 112 is shown in general outline, not distinguishing its liner, defining surface 127, from the bearing housing.

A principal difference in crusher 110, relative to crusher 10 of FIG. 1, is in the form of its eccentric shaft 132. Again, the shaft 132 has a lower portion 134 having an axis of rotation which is incident with the central axis A-B of the bowl 111, and an upper portion 133 which is integral with portion 134 and has an axis co-incident with the gyratory axis C-D. Also, the axes of portions 133 and 134 intersect at a point proximate to or at the lower end 126 of the head 112. Again, head 112 is mounted on the upper portion 133. However, the shaft 132 also has a drive portion 60 which projects above the top end of upper portion 133; the latter, in effect, being an intermediate portion and "upper" only in relation to lower portion 134.

The drive portion 60 of shaft 132 has an axis of rotation which is co-incident with the central axis A-B of the bowl 111 and, hence, with the axis of the lower portion 134. The upper end of shaft portion 133 thus is eccentric with respect to drive portion 60. The shaft portions 60 and 133 may be formed integrally or made integral. Alternatively, they may be releaseably interconnected in the required eccentric relationship, such as by dowel pins extending therebetween.

The crusher 110 has a drive assembly 113 for rotating shaft 132 on the central axis A-B. The assembly 113 is similar to assembly 13 of FIG. 1. However, assembly 113 is mounted at the top of crusher 110, in a fixed super-structure 61 mounted in relation to support frame 123 of crusher 210. The assembly 113 has its pinion 152 engaged with a crown wheel 153 secured around drive portion 60 of shaft 132. Its shaft 150 again is driven by belts (not shown), which pass around pulley 154, and by a motor (not shown).

Crusher 110 further differs from crusher 10 of FIG. 1 in the arrangement of bearings in which shaft 132 is rotatably mounted, and by which radial and axial forces induced in head 112 during crushing are transferred to shaft 132, and then to support frame 123 of the crusher 110. Only four bearings 62 to 65 are provided. The bearing 62 provides a mounting for drive portion 60 of shaft 132, each of the bearings 63 and 64 provide support for shaft portion 133, while bearing 65 provides support for lower portion 134.

The bearing 62 is a roller bearing arranged to transfer radial forces only from head 112, and has inner and outer raceways 62*a* and 62*b*, respectively, and rollers 62*c*. Outer raceway 62*b* is securely mounted in an annular housing 66 which is of T-section, with the head of that section disposed in frame structure 61. As shown, an annular recess 61*a* in structure 61 provides axial clearance for housing 66, such that the latter is able to move a short distance vertically, to accommodate minor constructional variations and differential thermal expansion and contraction. Due to such movement being allowed, housing 66 preferably is of a material resistant to fretting damage. The inner raceway 62*a* of the bearing 62 is a loose fit on drive portion 60 until correctly positioned, but then is fixed by inserting a tapered sleeve 62*d* between raceway 62*a* and drive portion 60.

The bearing 63 is a plain cylindrical roller bearing, located at the upper extent of shaft portion 133. The bearing 63 has inner and outer raceways 63*a* and 63*b*, and rollers 63*c* capture in the outer raceway 63*b*. The inner raceway 63*a* is able to pass axially into and out of the path of rollers 63*c* without restriction. This enables raceway 63*a* to be an interference fit on shaft portion 133 and outer raceway 63*b* to be an interference fit with an upper region of the bearing housing of the head 112.

The bearing 63 transfers radial loads, but does not transfer axial loads. However, as the inner raceway 63*a* is not restrained axially relative to rollers 63*c*, raceway 63*a* can move slightly in an axial direction to accommodate random constructional variations and differential thermal expansion and contraction.

The bearing 64 is a twin row roller bearing, mounted adjacent to the lower end of shaft portion 133. The bearing 64 has inner and outer races 64*a* and 64*b*, respectively, an upper set of barrel rollers 64*c* and a lower set of barrel rollers 64*d*; with the rollers 64*c* having an opposite roller axis to rollers 64*d*. The outer raceway 64*b* has a tight interference fit with the bearing housing of the head 112. However, inner raceway 64*a* is loose on shaft portion 133 but, when correctly positioned, it is fixed by a tapered sleeve 64*e* in the same manner as inner raceway 62*a* of the bearing 62.

The bearing 64 is able to transfer the radial and axial forces from the head 112. Thus, in being able to transfer radial crushing forces, the bearing 64 shares these forces with the bearing 63. However, bearing 64 transfers from the head 112 all axial crushing forces and all random axial forces. The bearing 64 is the only one of bearings 62 to 65 which controls the axial position of the head 112.

The bearing 65 is mounted the lower portion 134 of shaft 112. The bearing 65, has inner and outer raceways 65*a* and 65*b*, respectively, and two series of barrel rollers 65*c* and 65*d*. It has the same characteristics as the bearing 64 and its raceways are mounted in the same way as those of bearing 64, using a tapered sleeve 65*e* to fix raceway 64*a* to portion 134, except that the outer raceway 65*b* has an interference fit with frame 123. The bearing 65 transfers all of the axial forces from shaft 132 to frame 123, and with bearing 62 via frame structure 62, it shares the transfer of radial forces from the shaft 132 to the frame 123.

The crusher 110 is less preferred than crusher 10 of FIG. 1 in that, in replacement of its wear components, there is a greater exposure of the bearings mounting shaft 132 and of the drive assembly 113 to risk of contamination by harmful dirt. Also, there is a greater difficulty in providing an effective seal at the upper end of the head 112. However, the crusher 110 has its own advantages, which include:

(i) The crusher 110 enables a significantly reduced cost of manufacture. Its shaft 132 is of integral form, at least for portions 133 and 134, but optionally also drive portion 60. Also, only one bearing, the bearing 64, is required to transfer axial loads from the head and to fix the axial location of the head, reducing the need for extreme precision and cost for machined parts. Similarly, only one bearing, the bearing 65, is required to transfer axial loads from the shaft 132 to frame 123, and to axially locate the shaft, providing a further benefit in terms of the precision and costs for machined parts.

(ii) Fretting due to looseness at the inner races of the bearings is substantially eliminated, which makes components easier to assemble and very much easier to disassemble.

(iii) Assembly and disassembly is simplified, enabling an operator's service crew to replace worn components.

(iv) At least where drive portion 60 is integral with shaft portion 133, fretting between these portions is eliminated.

Finally, it is to be understood that various alterations, modifications and/or additions may be introduced into the constructions and arrangements of parts previously described without departing from the spirit or ambit of the invention.

We claim:

1. A gyratory crushing apparatus for crushing frangible or friable material, said apparatus including a bowl having an inner wall which defines a chamber for receiving the material, said chamber having a central axis and terminating in a throat defining a central discharge opening, a crushing head disposed in said bowl, said head having upper and lower ends which are interconnected by a peripheral wall which is concentric with respect to a gyratory axis of said head, a support assembly by which said head is supported in said chamber and which includes a shaft, and a drive arrangement coupled to said shaft, wherein said shaft is of integral construction having upper and lower portions, said head being mounted on said upper portion, with said upper portion having an axis substantially co-incident with the gyratory axis of said head, and said lower portion having an axis which is substantially co-incident with the central axis of said bowl, the axes of the upper and lower portions of said shaft intersecting at a fixed point located proximate to, or co-incident with, the lower end of said head such that, with rotation of said shaft about the axis of its lower portion under the action of the drive arrangement, gyratory motion is imparted to said head to provide a crushing action between said bowl and said peripheral wall of said head, on material received in said chamber.

2. Apparatus according to claim 1, including respective bearings to enable said head to rotate on said shaft and to enable said shaft to rotate relative to said bowl.

3. Apparatus according to claim 1, wherein said head is supported in position on said upper portion of said shaft by a plurality of head support bearings permitting relative rotational movement between said head and said upper portion of said shaft about the axis of said upper portion, said head support bearings being arranged to transfer, relative to the axis of said upper portion of the shaft, both axially and radially induced forces between said head and said shaft.

4. Apparatus according to claim 3, wherein the axial position of said head on the upper portion of the shaft is influenced by only one of said plurality of head support bearings.

5. Apparatus according to claim 3, wherein said head support bearings are arranged such that at least two of said bearings transfer radial forces between said head and said shaft, and wherein only one of said bearings is arranged to transfer axial forces between said head and said shaft.

6. Apparatus according to claim 5, wherein said one head support bearing arranged to transfer the axial forces influences the axial location of said head on said shaft, whereas said head support bearings arranged to transfer the radial forces retain said head substantially co-axial with the axis of said upper portion of said shaft.

7. Apparatus according to claim 1, wherein said shaft is mounted relative to said bowl through a plurality of shaft support bearings permitting rotation of said shaft relative to said bowl about the central axis of said chamber.

8. Apparatus according to claim 7, wherein said shaft is mounted to a support frame and said shaft support bearings are arranged to transfer, relative to the central axis of said chamber, both axially and radially induced forces between said shaft and said frame.

9. Apparatus according to claim 8, wherein said frame of said apparatus is arranged to support said bowl.

10. Apparatus according to claim 9, wherein each of said shaft support bearings is arranged to transfer only radial forces or axial forces between said shaft and said head or bowl.

11. Apparatus according to claim 9, wherein each of said shaft support bearings is arranged to transfer both radial and axial forces.

12. Apparatus according to claim 7, wherein only one of said shaft support bearings influences the axial position of said shaft relative to said bowl.

13. Apparatus according to claim 7, wherein at least two of said plurality of shaft support bearings are arranged to transfer radial forces between said shaft and said frame.

14. Apparatus according to claim 13, wherein only one of said plurality of shaft support bearings is arranged to transfer axial force.

15. Apparatus according to claim 14, wherein said shaft support bearing arranged to transfer the axial forces influences the axial location of said shaft relative to said bowl whereas said shaft support bearings arranged to transfer the radial forces align said shaft to retain the axis of said lower portion of said shaft substantially co-incident with the central axis of said chamber.

16. Apparatus according to claim 14, wherein said shaft support bearing which transfers the axial forces engages said lower portion of said shaft at a location remote from said fixed point.

17. Apparatus according to claim 1, wherein said shaft of said support assembly further includes a drive portion extending from said upper portion of said shaft, said drive portion being connected to or integrally formed with said upper portion of said shaft to maintain the integral construction of said shaft and arranged with its axis substantially co-incident with the central axis of said chamber.

18. Apparatus according to claim 17, wherein said drive arrangement is connected to said drive portion and is operable to rotate said shaft on the central axis of said chamber.

19. Apparatus according to claim 17, wherein said drive portion is integral with said upper portion of said shaft.

20. Apparatus according to claim 17, wherein said drive portion is connected to said upper portion of said shaft, and is separable from said upper portion.

21. Apparatus according to claim 20, wherein said drive portion and said upper portion are connected together by dowel pins to facilitate synchronized movement of said drive portion and said upper portion.

22. Apparatus according to claim 1, wherein said drive arrangement is connected to said lower portion of said shaft.

23. Apparatus according to claim 1, wherein said drive arrangement includes a hydraulic drive, a gear drive or a direct belt and pulley drive.

24. Apparatus according to claim 23, wherein said drive arrangement includes a bevelled gear drive having a bevelled gear pinion fixed on an input shaft and meshing with a bevelled gear located on said shaft.

25. Apparatus according to claim 24, wherein a belt and pulley system is used to transfer power from a drive motor or engine to said input shaft.

* * * * *